US006076910A

United States Patent [19]

Anderson

[11] Patent Number: 6,076,910

[45] Date of Patent: Jun. 20, 2000

[54] INK JET PRINTING APPARATUS HAVING REDUNDANT NOZZLES

[75] Inventor: Frank Edward Anderson, Sadieville, Ky.

[73] Assignee: Lexmark International, Inc., Lexington, Ky.

[21] Appl. No.: 08/964,362

[22] Filed: Nov. 4, 1997

[51] Int. Cl.[7] ..... B41J 29/38

[52] U.S. Cl. ..... 347/12; 347/19; 347/40

[58] Field of Search ..... 347/19, 12, 40, 347/41, 37

[56] References Cited

U.S. PATENT DOCUMENTS

| | | | |
|---|---|---|---|
| 4,097,873 | 6/1978 | Martin . | |
| 4,750,009 | 6/1988 | Yoshimura . | |
| 5,124,720 | 6/1992 | Schantz . | |
| 5,208,605 | 5/1993 | Drake . | |
| 5,327,166 | 7/1994 | Shimada . | |
| 5,344,079 | 9/1994 | Tasaki et al. . | |
| 5,349,375 | 9/1994 | Bolash et al. . | |
| 5,359,355 | 10/1994 | Nagoshi et al. . | |
| 5,398,053 | 3/1995 | Hirosawa et al. . | |
| 5,412,406 | 5/1995 | Fujimoto . | |
| 5,412,410 | 5/1995 | Rezanka . | |
| 5,428,380 | 6/1995 | Ebisawa . | |
| 5,469,198 | 11/1995 | Kadonaga . | |
| 5,473,351 | 12/1995 | Helterline et al. . | |
| 5,480,240 | 1/1996 | Bolash et al. . | |
| 5,486,848 | 1/1996 | Ayata et al. . | |
| 5,517,217 | 5/1996 | Haselby et al. | 347/23 |
| 5,559,930 | 9/1996 | Cariffe et al. . | |
| 5,563,637 | 10/1996 | Francis et al. . | |
| 5,581,284 | 12/1996 | Hermanson . | |
| 5,587,730 | 12/1996 | Karz . | |
| 5,598,192 | 1/1997 | Burger et al. . | |
| 5,612,722 | 3/1997 | Francis et al. . | |
| 5,627,572 | 5/1997 | Harrington, III et al. . | |
| 5,631,746 | 5/1997 | Overall et al. . | |
| 5,640,183 | 6/1997 | Hackleman . | |
| 5,825,377 | 10/1998 | Gotoh et al. | 347/15 |

FOREIGN PATENT DOCUMENTS

| | | |
|---|---|---|
| 0709212 | 5/1996 | European Pat. Off. . |
| 0 744 295 A1 | 11/1996 | European Pat. Off. . |
| 0 761 448 A2 | 3/1997 | European Pat. Off. . |
| 0 761 448 A3 | 10/1997 | European Pat. Off. . |
| WO96/32263 | 10/1996 | WIPO . |

*Primary Examiner*—Arthur T. Grimley
*Assistant Examiner*—Greg Moldafsky
*Attorney, Agent, or Firm*—Michael T. Sanderson

[57] ABSTRACT

An ink jet printing apparatus is provided comprising a print cartridge including a heater chip and a nozzle plate coupled to the heater chip. The heater chip has first, second, third and fourth heating elements, and the nozzle plate has a plurality of primary and secondary nozzles. The primary nozzles include first and second nozzles positioned in first and second nozzle plate columns and the secondary nozzles include third and fourth nozzles positioned in third and fourth nozzle plate columns. Each of the nozzles has one of the heating elements associated therewith for generating energy to discharge ink therefrom. The apparatus further includes a driver circuit, electrically coupled to the print cartridge, for applying firing pulses to the heating elements. The apparatus further includes a nozzle testing station. There, each nozzle is tested to determine if it is operable.

21 Claims, 11 Drawing Sheets

INK JET PRINTING APPARATUS HAVING REDUNDANT NOZZLES

CROSS REFERENCE TO RELATED APPLICATIONS

This application is related to contemporaneously filed U.S. patent application Ser. No. 08/964,282, entitled "INK JET PRINTING APPARATUS HAVING A PRINT CARTRIDGE WITH PRIMARY AND SECONDARY NOZZLES," by Frank E. Anderson et al., and U.S. patent application Ser. No. 08/964,478 now U.S. Pat. No. 5,984,455 entitled "INK JET PRINTING APPARATUS HAVING PRIMARY AND SECONDARY NOZZLES," by Frank E. Anderson, which are incorporated herein by reference.

FIELD OF THE INVENTION

This invention relates to ink jet printing apparatuses having at least one print cartridge with primary and secondary (redundant) nozzles.

BACKGROUND OF THE INVENTION

Drop-on-demand ink jet printers form a printed image by printing a pattern of individual dots or pixels on a print medium, such as a sheet of paper. The possible locations for the dots can be represented by an array or grid of pixels or square areas arranged in a rectilinear array of rows and columns wherein the center to center distance or dot pitch between pixels is determined by the resolution of the printer. The dots are printed as a printhead moves across the medium in a line scan direction. Between line scans, a stepper motor moves the print medium in a direction transverse to the line scan direction.

Drop-on-demand ink jet printers use thermal energy to produce a vapor bubble in an ink-filled chamber to expel a droplet. A thermal energy generator or heating element, usually a resistor, is located in the chamber on a heater chip near a discharge nozzle. A plurality of chambers, each provided with a single heating element, are provided in the printers printhead. The printhead typically comprises the heater chip and a nozzle plate having a plurality of the discharge nozzles formed therein. The printhead forms part of an ink jet print cartridge which also comprises an ink-filled container.

In one conventional printhead, discharge nozzles are arranged in two columns, with the nozzles of one column staggered relative to the nozzles of the other column. During use, the two columns function as a single column. Hence, each horizontal row of dots is printed by only a single nozzle. If a nozzle falls, the printed document will include horizontal blank lines where ink is absent due to the defective nozzle not printing dots along those lines.

Printer manufacturers are constantly searching for techniques which may be used to improve printing speed. One known technique involves adding additional nozzles to each nozzle column on the printhead. However, as nozzle column length increases, proper nozzle alignment along the columns becomes more critical. This is because print misalignment resulting from nozzle misalignment becomes more noticeable as nozzle column length increases.

An improved printhead which allows for increased printing speed and improved print quality is desired.

SUMMARY OF THE INVENTION

In accordance with the present invention, an ink let printing apparatus is provided having a printhead with a plurality of primary and secondary nozzles. The primary nozzles include first and second nozzles positioned in first and second nozzle plate columns. The secondary nozzles include third and fourth nozzles positioned in third and fourth nozzle plate columns. The secondary nozzles define redundant nozzles. That is, each secondary nozzle shares a horizontal axis with a primary nozzle. Thus, instead of having two columns of nozzles, which function as a single vertical line of nozzles, printing a swath of data during a single pass of the printhead, there are four columns of nozzles, which function as two vertical lines of nozzles, printing the data. Each vertical line of nozzles is capable of printing approximately one-half of the pixels printed during a given pass of the printhead across the print medium. The printer is selectively operable in one of a normal mode of operation and a high speed mode of operation. During normal mode operation, the heating elements associated with the first nozzles are fired during a first segment of a firing cycle, the heating elements associated with the second nozzles are fired during a second segment of the firing cycle, the heating elements associated with the fourth nozzles are fired during a third segment of the firing cycle, and the heating elements associated with the third nozzles are fired during a fourth segment of the firing cycle. During high speed mode operation, the heating elements associated with the first and third nozzles are fired during a first segment of a high speed mode firing cycle and the heating elements associated with the second and fourth nozzles are fired during a second segment of the high speed mode firing cycle. Due to the redundant nozzles, the printer may be operated at an increased speed.

It is further contemplated that the printer may be provided with a nozzle testing station. There, each nozzle is tested to determine if it is operable. If not, its associated nozzle found on the same horizontal line does double duty during normal speed operation. Hence, if a nozzle fails and b associated nozzle is operable, all of the data to be printed by the nozzle pair will be printed during normal mode operation.

By adding redundant nozzles, nozzle column length has not been substantially increased. This is an advantage as print misalignment resulting from nozzle misalignment becomes more noticeable as nozzle column length increases.

DETAILED DESCRIPTION OF THE PREFERRED EMBODIMENTS

Figure 1:
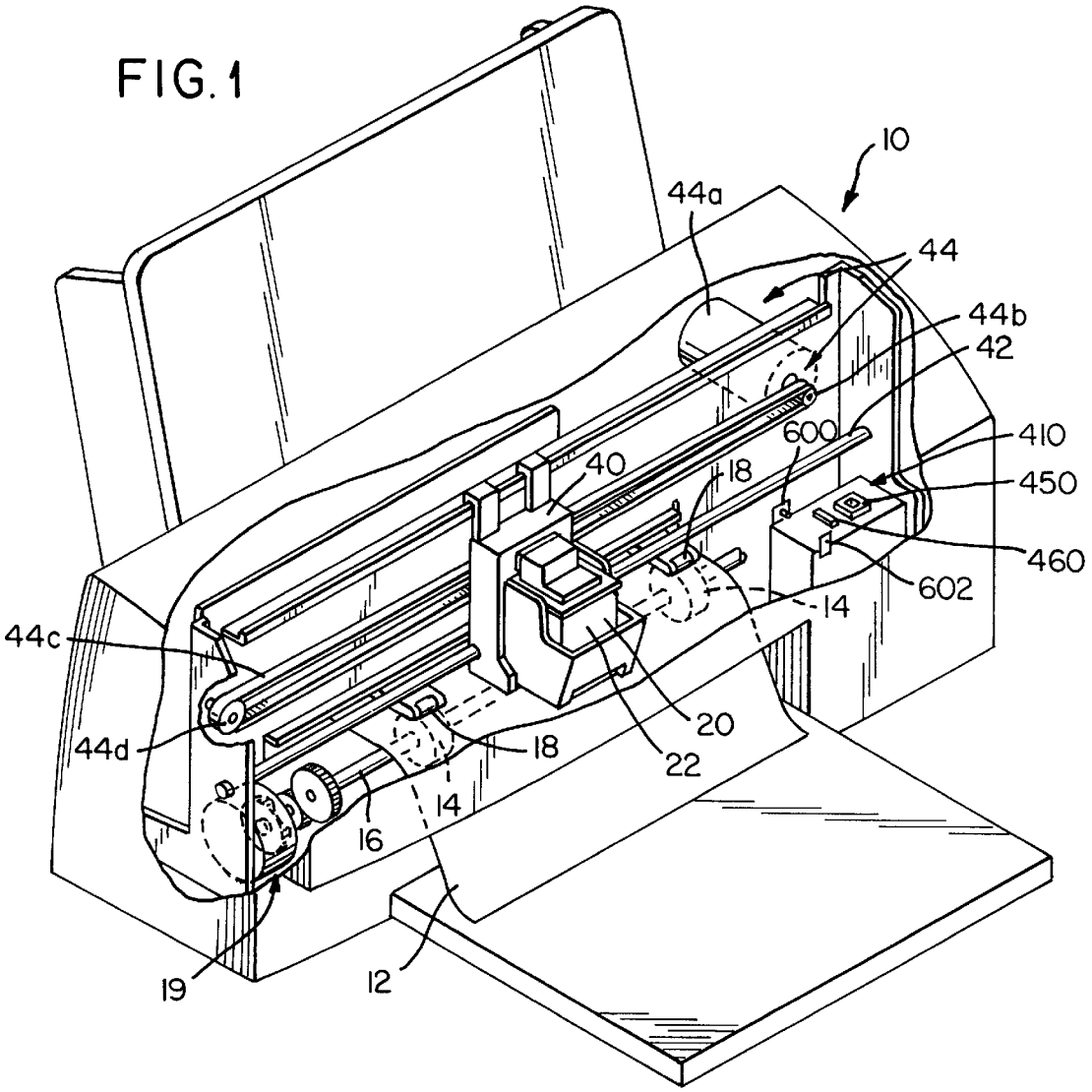
FIG. 1 is a perspective view of an ink jet printing apparatus having a print cartridge constructed in accordance with the present invention.

Referring now to FIG. 1, there is shown an inkjet printing apparatus 10 having a print cartridge 20 constructed in accordance with the present invention. The cartridge 20 is supported in a carrier 40 which, in turn, is slidably supported on a guide rail 42. A print cartridge drive mechanism 44 is provided for effecting reciprocating movement of the carrier 40 back and forth along the guide rail 42. The drive mechanism 44 includes a motor 44*a* with a drive pulley 44*b* and a drive belt 44*c* which extends about the drive pulley 44*b* and an idler pulley 44*d*. The carrier 40 is fixedly connected to the drive belt 44*c* so as to move with the drive belt 44*c*. Operation of the motor 44*a* effects back and forth movement of the drive belt 44*c* and, hence, back and forth movement of the carrier 40 and the print cartridge 20. As the print cartridge 20 moves back and forth, it ejects ink droplets onto a paper substrate 12 provided below it. Driven rollers 14 mounted on a shaft 16 cooperate with pressure rollers 18 to advance the paper substrate 12 in a direction generally orthogonal to the direction of print cartridge movement. The shaft 16 is driven by a stepper motor assembly 19.

Figure 2:
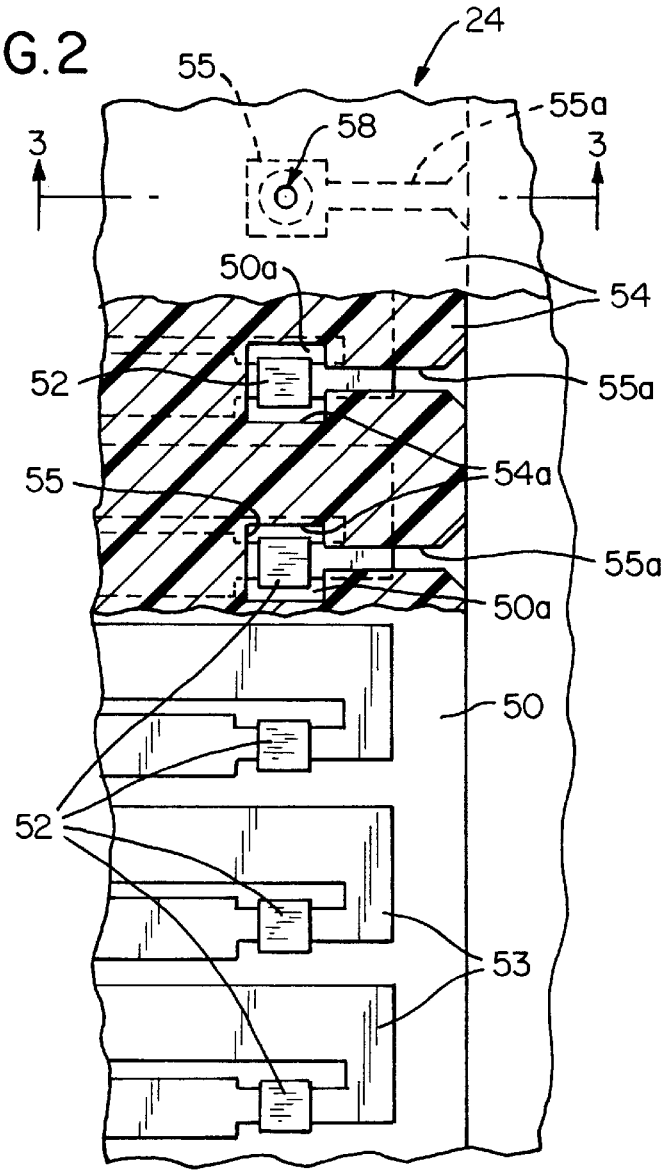
FIG. 2 is a view of a portion of a heater chip coupled to an nozzle plate with sections of the nozzle plate removed at two different levels.
Figure 3:
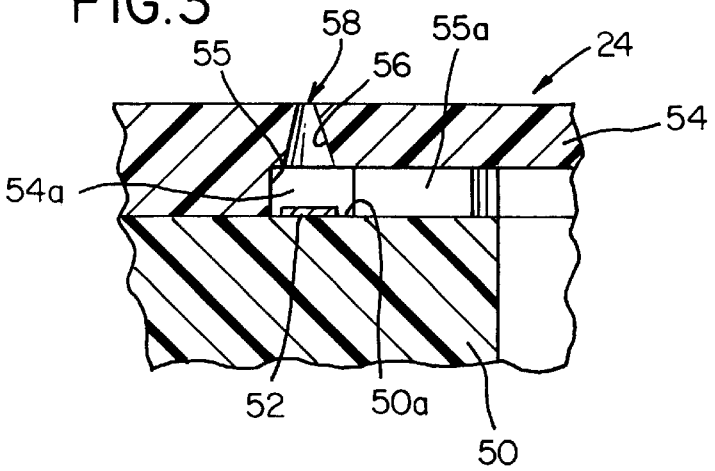
FIG. 3 is a view taken along section line 3—3 in FIG. 2.

The print cartridge 20 comprises a polymeric container 22, see FIG. 1, filled with ink and a printhead 24, see FIGS. 2 and 3. The printhead 24 comprises a heater chip 50 having a plurality of resistive heating elements 52. The printhead 24 further includes a nozzle plate 54 having a plurality of openings 56 extending through it which define a plurality of nozzles 58 through which ink droplets are ejected. The diameter of each nozzle 58 is from about 15 microns to about 28 microns.

The nozzle plate 54 may be formed from a flexible polymeric material substrate which is adhered to the heater chip 22 via an adhesive (not shown). Examples of polymeric materials from which the nozzle plate 54 may be formed and adhesives for securing the plate 54 to the heater chip 50 are set out in commonly assigned patent application, U.S. Ser. No. 08/519,908, entitled "METHOD OF FORMING AN INKJET PRINTHEAD NOZZLE STRUCTURE," by Tonya H. Jackson et al., filed on Aug. 28, 1995, Attorney Docket No. LE9-95-024, the disclosure of which is hereby incorporated by reference. As noted therein, the plate 54 may be formed from a polymeric material such as polyimide, polyester, fluorocarbon polymer, or polycarbonate, which is preferably about 15 to about 200 microns thick, and most preferably about 50 to about 125 microns thick. Examples of commercially available plate materials include a polyimide material available from E.I. DuPont de Nemours & Co. under the trademark "KAPTON" and a polyimide material available from Ube (of Japan) under the trademark "UPILEX."

The plate 54 may be bonded to the chip 50 via any art recognized technique, including a thermocompression bonding process. When the plate 54 and the heater chip 50 are joined together, sections 54*a* of the plate 54 and portions 50*a* of the heater chip 50 define a plurality of bubble chambers 65. Ink supplied by the container 22 flows into the bubble chambers 55 through ink supply channels 55*a*. The resistive heating elements 52 are positioned on the heater chip 50 such that each bubble chamber 55 has only one heating element 52. Each bubble chamber 55 communicates with one nozzle 58, see FIG. 3.

Figure 7:
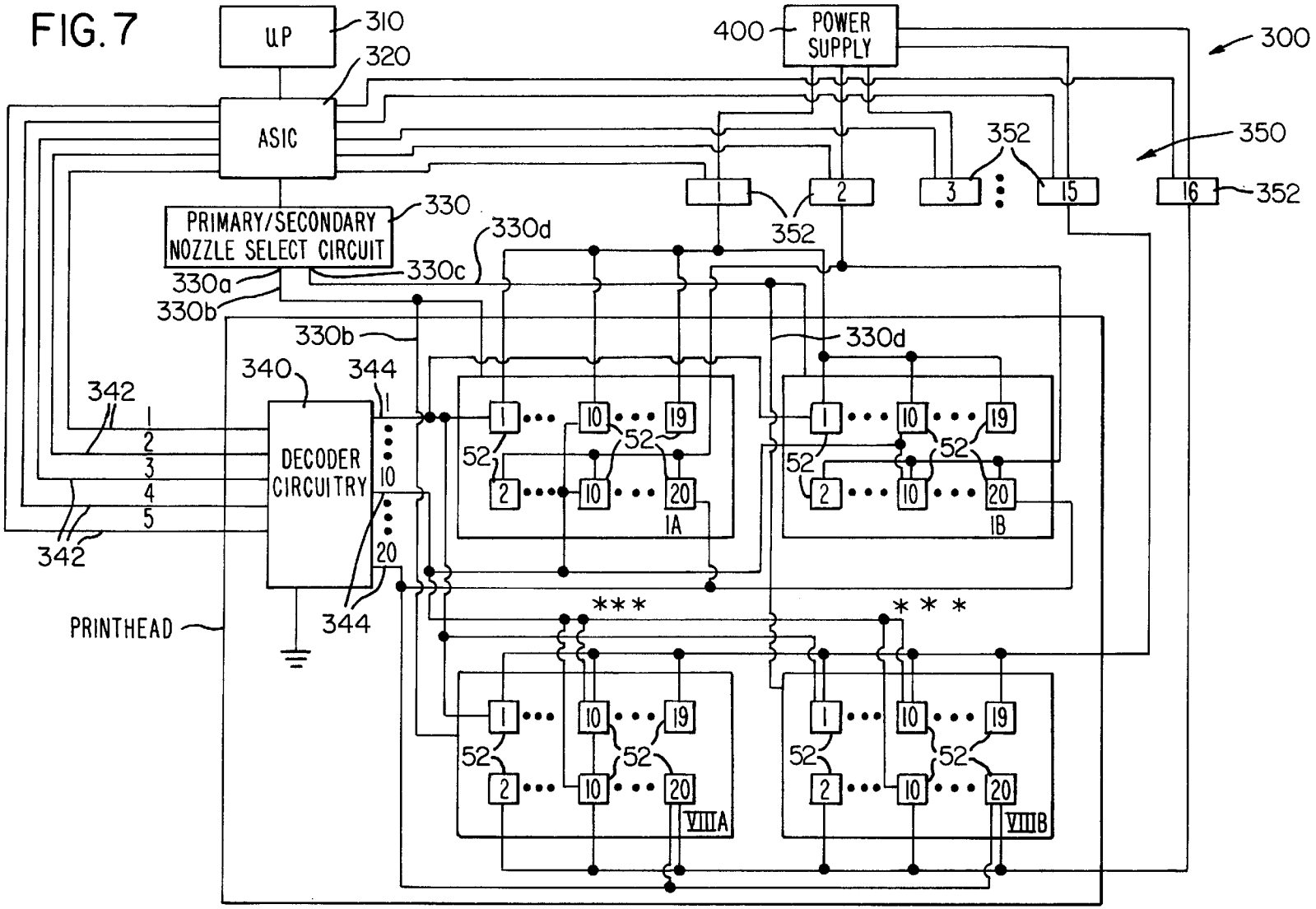
FIG. 7 is a schematic diagram illustrating the driver circuit of the present invention.

The resistive heating elements 52 are individually addressed by voltage pulses provided by a driver circuit 300, see FIG. 7. Each voltage pulse is applied to one of the heating elements 52 to momentarily vaporize the ink in contact with that heating element 52 to form a bubble within the bubble chamber 55 in which the heating element 52 is found. The function of the bubble is to displace ink within the bubble chamber 55 such that a droplet of ink is expelled from a nozzle 58 associated with the bubble chamber 55.

A flexible circuit (not shown) secured to the polymeric container 22 is used to provide a path for energy pulses to travel from the driver circuit 300 to the heater chip 50. Bond pads (not shown) on the heater chip 50 are bonded to end sections of traces (not shown) on the flexible circuit. Current flows from the circuit 300 to the traces on the flexible circuit and from the traces to the bond pads on the heater chip 50. The current then flows from the bond pads along conductors 53 to the heating elements 52.

Figure 4:
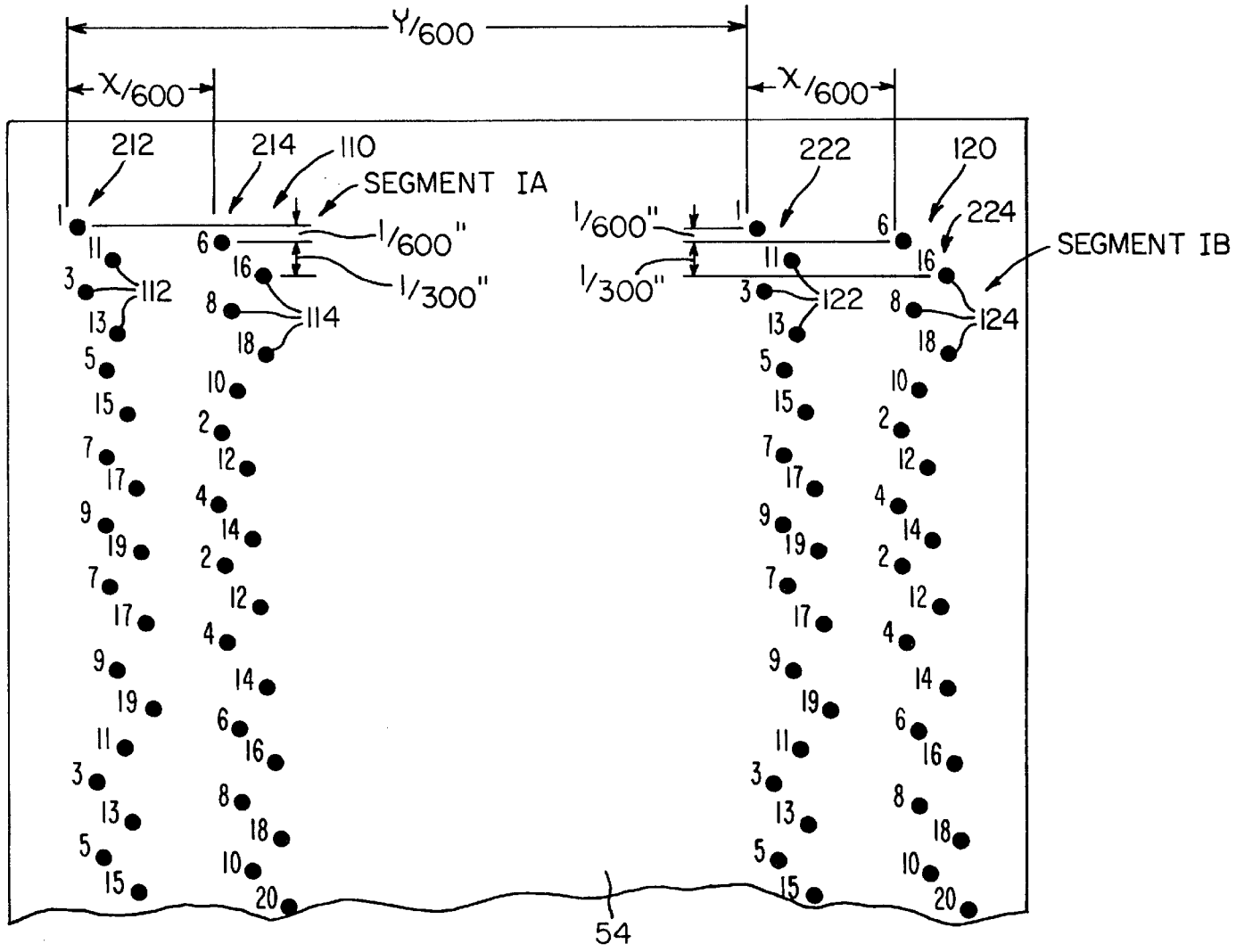
FIG. 4 is a schematic illustration of a portion of a nozzle plate with first and second nozzles of segment IA and third and fourth nozzles of segment IB represented by solid dots.
Figure 5:
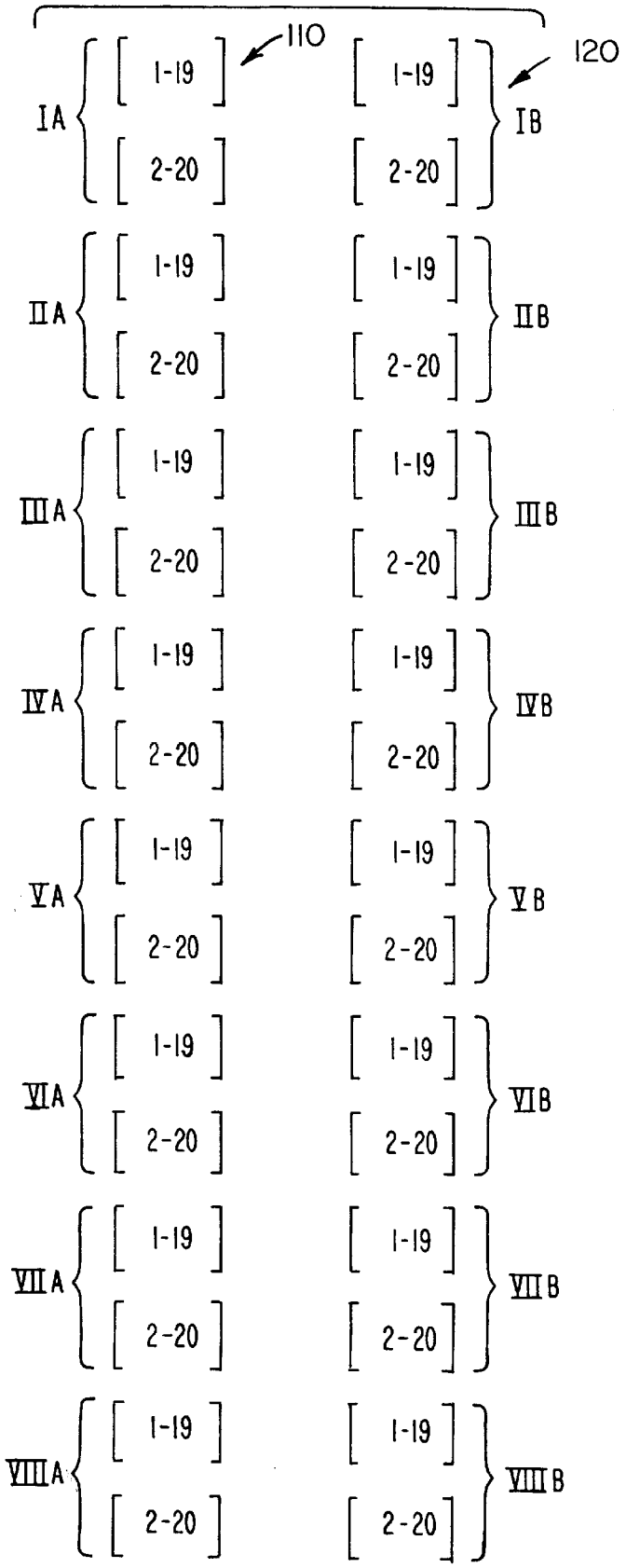
FIG. 5 is an illustration of a nozzle plate with primary and secondary nozzles of segments IA–VIIIA and segments IB–VIIIB numerically designated.

In accordance with the present invention, the nozzle plate 54 is provided with a plurality of primary nozzle 110 and secondary nozzles 120, see FIG. 4. In the illustrated embodiment, there are eight segments IA–VIIIA of primary nozzles 110, each segment having 38 nozzles, as represented in FIG. 5. Thus, the total number of primary nozzles 110, in the illustrated embodiment, equals 304 nozzles. Similarly, there are eight segments IB–VIIIB of secondary nozzles 120, each segment having 38 nozzles. The total number of secondary nozzles 120 equals 304 nozzles. The specific number of primary and secondary nozzles 110 and 120 formed on the nozzle plate 54 are mentioned herein for illustrative purposes only. Hence, the number of primary and secondary nozzles 110 and 120 are not intended to be limited to those represented in FIG. 5.

Figure 6:
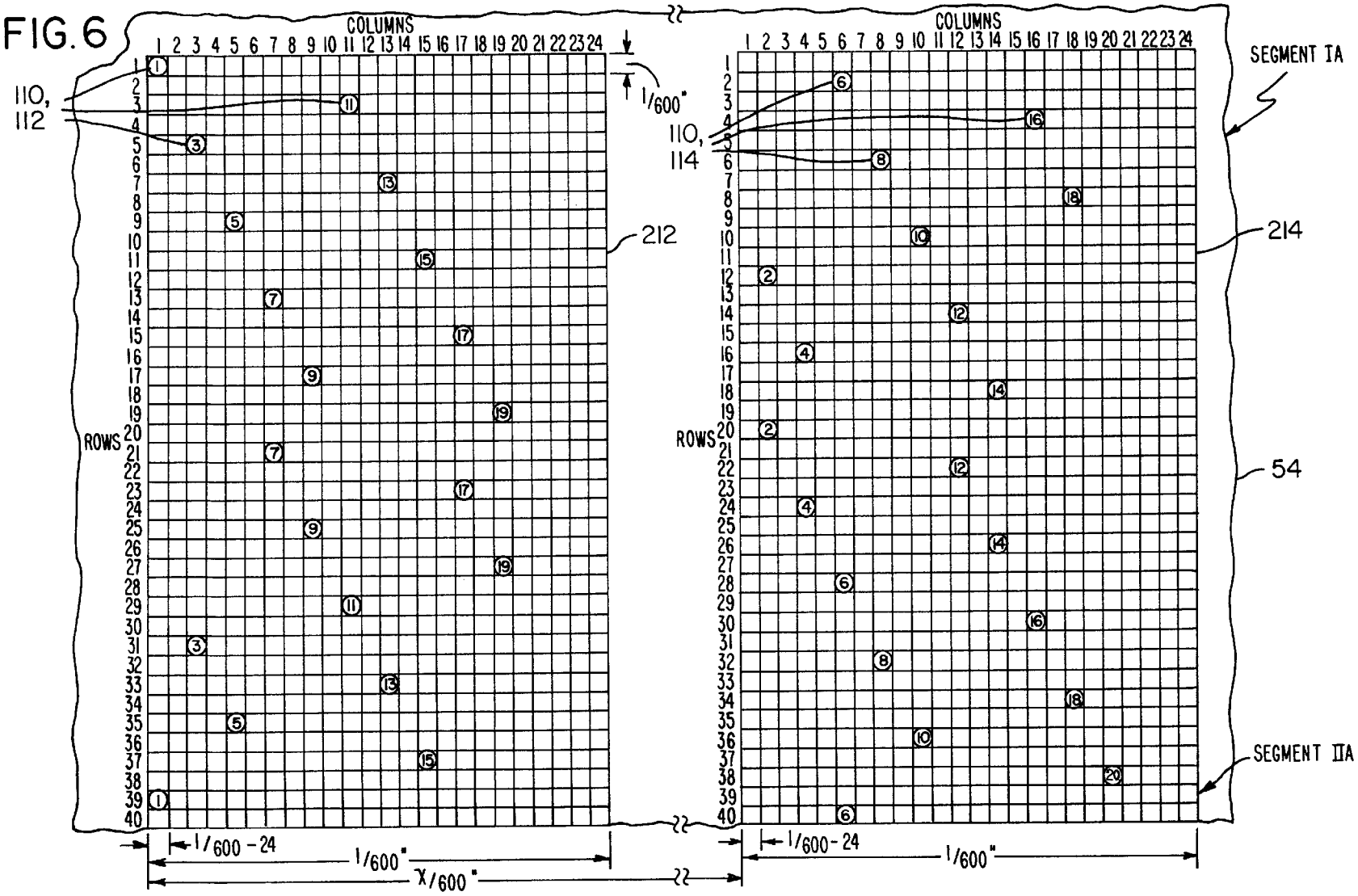
FIG. 6 is an illustration of a portion of a nozzle plate with first and second nozzles of segment IA and two nozzles of segment IIA represented by numbered circles.

The primary nozzles 110 include first and second nozzles 112 and 114 positioned in first and second nozzle plate columns 212 and 214, see FIGS. 4 and 6. The secondary nozzles 120 include third and fourth nozzles 122 and 124 positioned in third and fourth nozzle plate columns 222 and 224, see FIG. 4. Front sections of the first and second columns 212 and 214 are spaced apart from one another by a distance equal to $X/600$ inch, wherein X is an odd integer$\geqq 3$ and $\geqq 9$, see FIGS. 4 and 6. Front sections of the third and fourth columns 222 and 224 are spaced apart from one another by a distance equal to $X/600$ inch, wherein X is an odd integer$\geqq 3$ and $\geqq 9$, see FIG. 4. Front sections of the first and third columns 212 and 222 are spaced apart from one another by a distance equal to $Y/600$ inch, wherein Y is an odd integer$\geqq 11$, see FIG. 4. In the illustrated embodiment, X=3 and Y=83.

The first and second nozzles 112 and 114 of segment IA and the third and fourth nozzles 122 and 124 of segment IB are represented in FIG. 4 by solid dots with numbers positioned adjacent to the dots. The first and second nozzles 112 and 114 of segment IA and two nozzles of segment IIA are illustrated in FIG. 6 by numbered circles. The first nozzles 112 are represented by odd-numbered circles and the second nozzles 114 are represented by even-numbered circles. The 38 nozzles of each of segments IA and IB are numbered 1–19 and 2–20 in FIGS. 4–8.

The vertical distance between center points of adjacent first and second nozzles 112 and 114 positioned in adjacent horizontal rows in the columns 212 and 214, e.g., nozzles 1 and 6 located in rows 1 and 2, is approximately 1/600 inch, see FIGS. 4 and 6. The vertical distance between center points of adjacent third and fourth nozzles 122 and 124 positioned in adjacent horizontal rows in the third and fourth columns 222 and 224, e.g., nozzles 1 and 6, is also about 1/600 inch, see FIG. 4. The vertical distance between center points of vertically adjacent first nozzles 112, e.g., nozzles 1 and 11, is approximately 1/300 inch. Similarly, the vertical distance between vertically adjacent second nozzles 114, third nozzles 122 and fourth nozzles 124 is approximately 1/300 inch.

The numbers adjacent to the dots in FIG. 4 and within the circles in FIG. 6 designate vertical subcolumns within the nozzle plate columns 212 and 214 in which center points of the nozzles 112 and 114 are found. As indicated in FIG. 6, the width of each vertical subcolumn within each of the nozzle plate columns 212 and 214 is 1/14,400 inch. Thus, the horizontal distance between the center points of two horizontally adjacent first nozzles 112, e.g., nozzles 1 and 3, is approximately 2/14,400 inch. Similarly, the horizontal distance between the center points of two horizontally adjacent second nozzles 114, e.g., nozzles 2 and 4, is approximately 2/14,400.

In the illustrated embodiment, the 38 nozzles of each of segments IA–VIIIA and segments IB–VIIIB are arranged in the same order and are spaced from another in the same manner as are the 38 nozzles of segment IA. Thus, the secondary nozzles 120 are arranged in the same order and spaced from one another in the same manner as the primary nozzles 110. Accordingly, the order and spacing of the secondary nozzles 120 will not be further described herein.

The driver circuit 300 comprises a microprocessor 310, an application specific integrated circuit (ASIC) 320, a primary nozzle/secondary nozzle select circuit 330, decoder circuitry 340 and a common drive circuit 350.

The primary nozzle/secondary nozzle select circuit 330 selectively enables one or both of the primary nozzle segments IA–VIIIA and the secondary nozzle segments IB–VIIIB. It has a first output 330*a* which is electrically coupled to the primary nozzles 110 via conductor 330*b*. It also has a second output 330*c* which is electrically coupled to the secondary nozzles 120 via a conductor 330*d*. Thus, a first select signal present at the first output 330*a* is used to select the operation of the primary nozzles 110 while a second select signal present at the second output 330*c* is used to select the operation of the secondary nozzles 120. The primary nozzle/secondary nozzle select circuit 330 is electrically coupled to the ASIC 320 and generates appropriate select signals in response to command signals received from the ASIC 320.

As noted above, there is a single resistive heating element 52 associated with each of the primary and secondary nozzles 110 and 120. In FIG. 7, the illustrated resistive heating elements 52 are numbered and grouped so as to correspond with the nozzle numbering and segment groupings used in FIGS. 4–6.

The common drive circuit 350 comprises a plurality of drivers 352 which are electrically coupled to a power supply 400, the ASIC 320 and the resistive heating elements 52. In the illustrated embodiment, sixteen drivers 352 are provided. Each of the sixteen drivers 352 is electrically coupled to one-half of the heating elements 52 associated with one of the primary nozzle segments IA–VIIIA and one-half of the heating elements 52 associated with one of the secondary nozzle segments IB–VIIIB. In FIG. 7, the first driver 352, i.e., the driver designated number 1, is coupled to the heating elements 52 associated with the upper one-half of the nozzles 110 of the primary nozzle segment IA, i.e., the nozzles numbered 1–19 in FIGS. 4–6, and the heating elements 52 associated with the upper one-half of the nozzles 120 of the secondary nozzle segment IB. The second driver 352, i.e., the driver designated number 2, is coupled to the heating elements 52 associated with the lower one-half of the nozzles 110 of the primary nozzle segment IA, i.e., the nozzles numbered 2–20 in FIGS. 4–6, and the heating elements 52 associated with the lower one-half of the nozzles 120 of the secondary nozzle segment IB. The fifteenth driver 362, i.e., the driver designated number 15, is coupled to the heating elements 52 associated with the upper one-half of the nozzles 110 of the primary nozzle segment VIIIA, and the heating elements 52 associated with the upper one-half of the nozzles 120 of the secondary nozzle segment VIIIB. The sixteenth driver 352, i.e., the driver numbered 16, is coupled to the heating elements 52 associated with the lower one-half of the nozzles 110 of the primary nozzle segment VIIIA, and the heating elements 52 associated with the lower one-half of the nozzles 120 of the secondary nozzle segment VIIIB.

There are five input lines 342 extending from the ASIC 320 to the decoder circuitry 340. Twenty address lines 344 extend from the decoder circuitry 340 to the resistive heating elements 52. Each address line 344 extends to heating elements 52 associated with like numbered nozzles in each of the primary and secondary segments IA–VIIIA and IB–VIIIB. For example, the first address line 344, i.e., the address line numbered 1 in FIG. 7, is connected to the resistive heating elements 52 associated with the number 1 primary and secondary nozzles 110 and 120 in each of the primary and secondary segments IA–VIIIA and IB–VIIIB. The tenth address line 344, i.e., the address line numbered 10 in FIG. 7, is connected to the resistive heating elements 52 associated with the number 10 primary and secondary nozzles in each of the primary and secondary segments IA–VIIIA and IB–VIIIB. The twentieth address line 344, i.e., the address line numbered 20 in FIG. 7, is connected to the resistive heating elements 52 associated with the number 20 primary and secondary nozzles in each of the primary and secondary segments IA–VIIIA and IB–VIIIB. As will be discussed more explicitly below, the ASIC 320 sends appropriate signals to the decoder circuitry 340 such that during a given firing cycle, the decoder circuitry 340 generates appropriate address signals to the heating elements 52 associated with the primary and secondary nozzles 110 and 120.

Each driver 352 is only activated by the ASIC 320 when one of the heating elements 52 to which it is connected is to be fired. The specific heating elements 52 fired during a given firing cycle depends upon print data received by the microprocessor 310 from a separate processor (not shown) electrically coupled to it. The microprocessor 310 generates signals which are passed to the ASIC 320 and, in turn, the ASIC 320 generates appropriate firing signals which are passed to the sixteen drivers 352. The activated drivers 352 then apply firing voltage pulses to the heating elements 52 in conjunction with the ground path provided by the decoder circuitry 340.

If the heating element associated with the number 1 primary nozzle 110 in segment IA is to be fired during a given firing cycle segment, the first driver 352 will be activated simultaneously with the activation of the first output 330*a* of the select circuit 330 and the first address line 344. If the number 2 primary nozzle 110 in segment IA is not to be fired during a given normal speed mode firing cycle segment (the normal speed mode will be discussed below), the second driver 352 will not be fired when the first output 330*a* of the select circuit 330 and the second address line 344 are simultaneously activated. If the upper-most primary nozzle 110 numbered 10 in segment IA is to be fired, the first driver 352 will be fired when the first output 330*a* of the select circuit 330 and the tenth address line 344 are simultaneously activated. If the lower-most primary nozzle 110 numbered 10 in segment IA is not to be fired during a given normal speed mode firing cycle segment, the second driver 352 will not be fired when the first output 330*a* of the select circuit 330 and the tenth address line 344 are simultaneously activated.

The printing apparatus 10 is selectively operable in one of a normal mode of operation and a high speed mode of operation. The user of the apparatus 10 may select the desired mode via software during printer set up.

Figure 8:
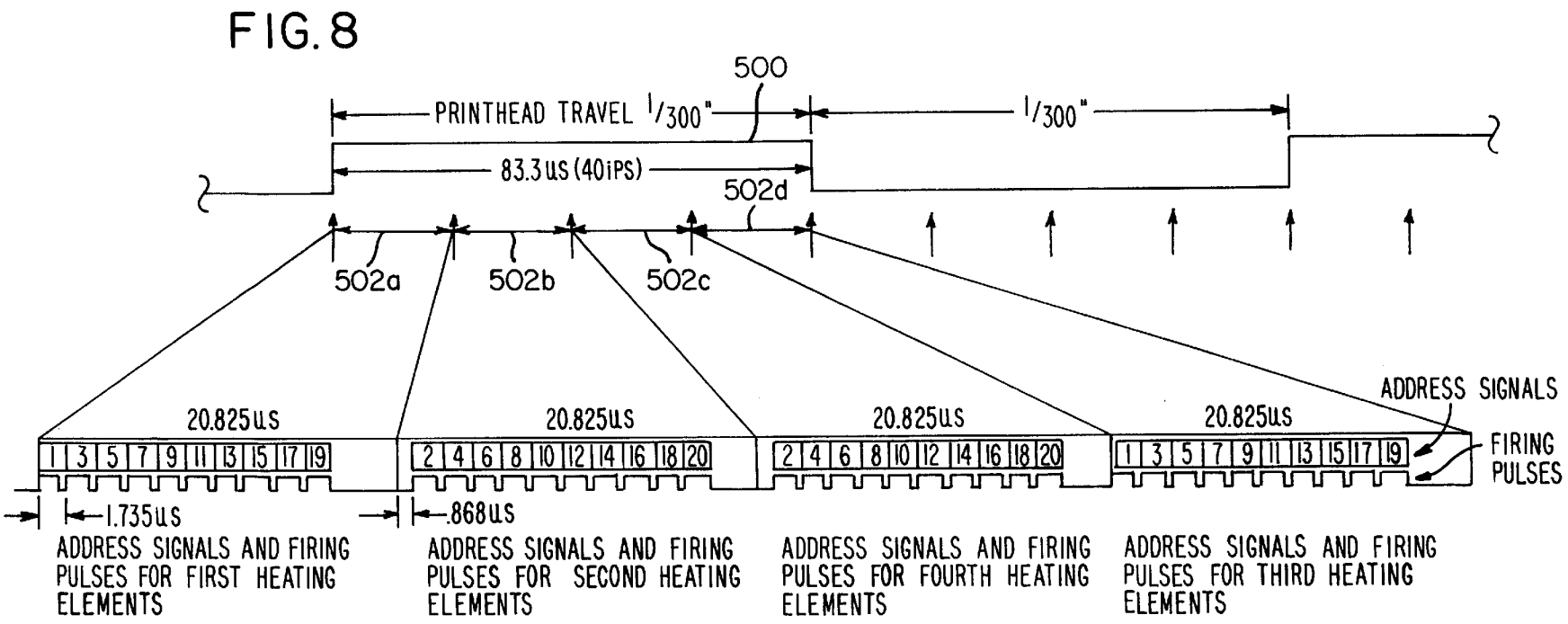
FIG. 8 is a timing diagram for normal speed mode operation.

A timing diagram for the normal speed mode of operation is illustrated in FIG. 8, wherein an expanded normal speed mode firing cycle 500 is shown. The driver circuit 300 is capable of applying, depending upon print data received by the microprocessor 310 from the separate processor (not shown) electrically coupled to it, first firing pulses to first heating elements 52, i.e., the heating elements 52 associated with the first nozzles 112 (the odd-numbered primary nozzles), during a first segment 602*a* of each normal speed mode firing cycle, second firing pulses to second heating elements 62, i.e., the heating elements 52 associated with the second nozzles 114 (the even-numbered primary nozzles), during a second segment 502*b* of each normal speed mode firing cycle, third firing pulses to fourth heating elements 52, i.e., the heating elements 52 associated with the fourth nozzles 124 (the even-numbered secondary nozzles), during a third segment 502*c* of each normal speed mode firing cycle, and fourth firing pulses to third heating elements 52, i.e., the heating elements 52 associated with the third nozzles 122 (the odd-numbered secondary nozzles), during a fourth segment 502*d* of each normal speed mode firing cycle.

As illustrated in FIG. 8, during the first and fourth segments 502*a* and 502*d* of each normal speed mode firing cycle, the ASIC 320 causes the decoder circuitry 340 to cycle through its odd address lines 344. During the second and third segments 502*b* and 502*c* of each normal speed mode firing cycle, the ASIC 320 causes the decoder circuitry 340 to cycle through its even address lines 344. The first output 330*a* is active only during the first and second segments 502*a* and 502*b*. The second output 330*c* is active only during the third and fourth segments 502*c* and 502*d*.

During the first segment 502*a* of the normal speed mode firing cycle, the first output 330*a* is active and, depending upon the print data received by the microprocessor 310, the appropriate drivers 352 are activated as the decoder circuitry 340 cycles through its odd address lines 344 such that the desired first heating elements associated with the first nozzles 112 in segments IA–VIIIA are fired. During the second segment 602*b* of the normal speed mode firing cycle, the first output 330*a* is active and, depending upon the print data received by the microprocessor 310, the appropriate drivers 352 are activated as the decoder circuitry 340 cycles through its even address lines 344 such that the desired second heating elements 52 associated with the second nozzles 114 in segments IA–VIIIA are fired. During the third segment 502*c* of the normal speed mode firing cycle, the second output 330*c* is active and, depending upon the print data received by the microprocessor 310, the appropriate drivers 352 are activated as the decoder circuitry 340 cycles through its even address lines 344 such that the desired fourth heating elements 52 associated with the fourth nozzles 124 in segments IB–VIIIB are fired. During the fourth segment 502*d* of the normal speed mode firing cycle, the second output 330*c* is active and, depending upon the print data received by the microprocessor 310, the appropriate drivers 352 are activated as the decoder circuitry 340 cycles through its odd address lines 344 such that the desired third heating elements 52 associated with the third nozzles 122 in segments IB–VIIIB are fired.

The length of time of each of the first, second, third and fourth segments 502*a*–502*d* of the normal speed mode firing cycle is from about 15 μseconds to about 25 μseconds. The printhead speed is from about 33.33 inches/second to about 55.56 inches/second. In the illustrated embodiment, the length of time of each of the segments 502*a*–602*d* is about 20.825 μseconds such that the total firing cycle time is approximately 83.3 μseconds. Further, the printhead speed is about 40 inches/second such that the printhead travels approximately 1/300 inch per firing cycle.

It is noted that at the beginning of each of the second and third segments 502*b* and 502*c* of the normal speed mode firing cycle, a delay of about 0.868 μseconds occurs before the heating element 52 associated with the number 2 second nozzle 114 and the number 2 fourth nozzle 124 are fired.

Figure 9:
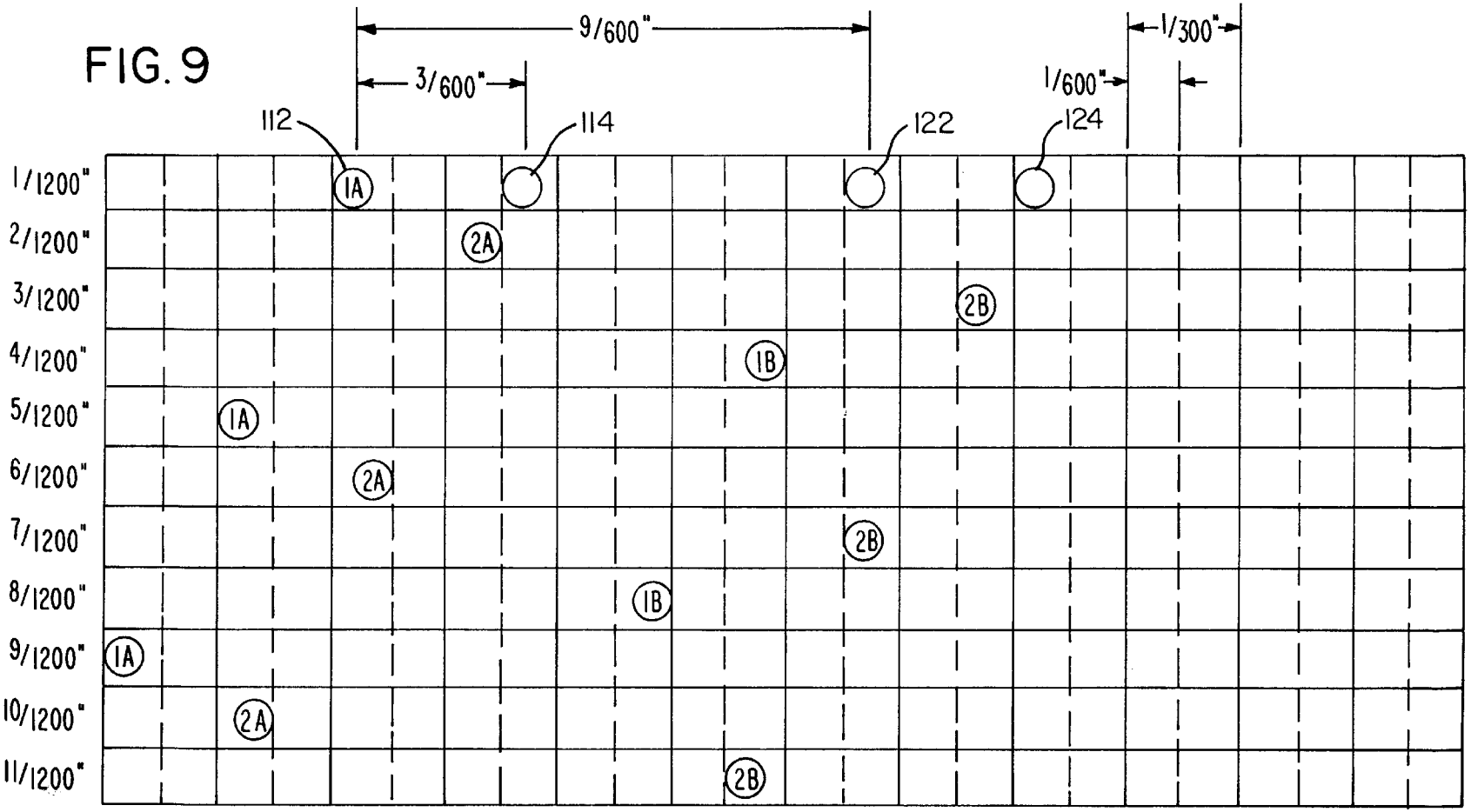
FIG. 9 is a plot showing dots generated by first, second, fourth and third nozzles during consecutive segments of normal speed mode firing cycles.

In FIG. 9, a plot is illustrated showing dots generated by a first nozzle 112, a second nozzle 114, a third nozzle 122 and a fourth nozzle 124 during normal speed mode operation. The initial positions of the nozzles 112, 114, 122 and 124 are shown. For illustrative purposes, the distance between the first and third nozzles 112 and 122 is 9/600 inch. Dots generated by the nozzles 112, 114, 122 and 124 are represented by numbered circles, wherein dots IA are formed by the first nozzle 112, dots 2A are formed by the second nozzle 114, dots 1B are formed by the third nozzle 122 and dots 2B are formed by the fourth nozzle 124. As can be seen from FIG. 9, during a first segment 502*a* of a first normal speed mode firing cycle, nozzle 112 is fired and the printhead moves a distance across the paper substrate 12 (from right to left) equal to 1/1200 inch. During a second segment 502*b* of the first normal speed mode firing cycle, nozzle 114 is fired and the printhead moves another 1/1200 inch across the paper substrate 12. The dot 2A created by the nozzle 114 is horizontally spaced approximately 5/1200 inch from the dot 1A created by the nozzle 112. During a third segment 502*c* of the first normal speed firing cycle, nozzle 124 is fired and the printhead moves another 1/1200 inch across the paper substrate 12. During a fourth segment 602*d* of the first normal speed firing cycle, nozzle 122 is fired and the printhead moves another 1/1200 inch across the paper substrate 12. The dot 2B created by nozzle 124 is horizontally spaced approximately 7/1200 inch from the dot 1B created by the nozzle 122. As is apparent from FIG. 9, dot pairs 1A/1B and 2A/2B are in different 1/600" halves of the 1/300" windows. Thus, 600 dots per inch horizontal resolution occurs during normal speed mode printing. This results because the first and second columns 212 and 214 are spaced apart from one another by a distance equal to X/600 inch, wherein X is an odd integer; the third and fourth columns are spaced apart from one another by a distance equal to X/600 inch, wherein X is an odd integer; and the first and third columns are spaced apart from one another by a distance equal to Y/600 inch, wherein Y is an odd integer.

Figure 10:
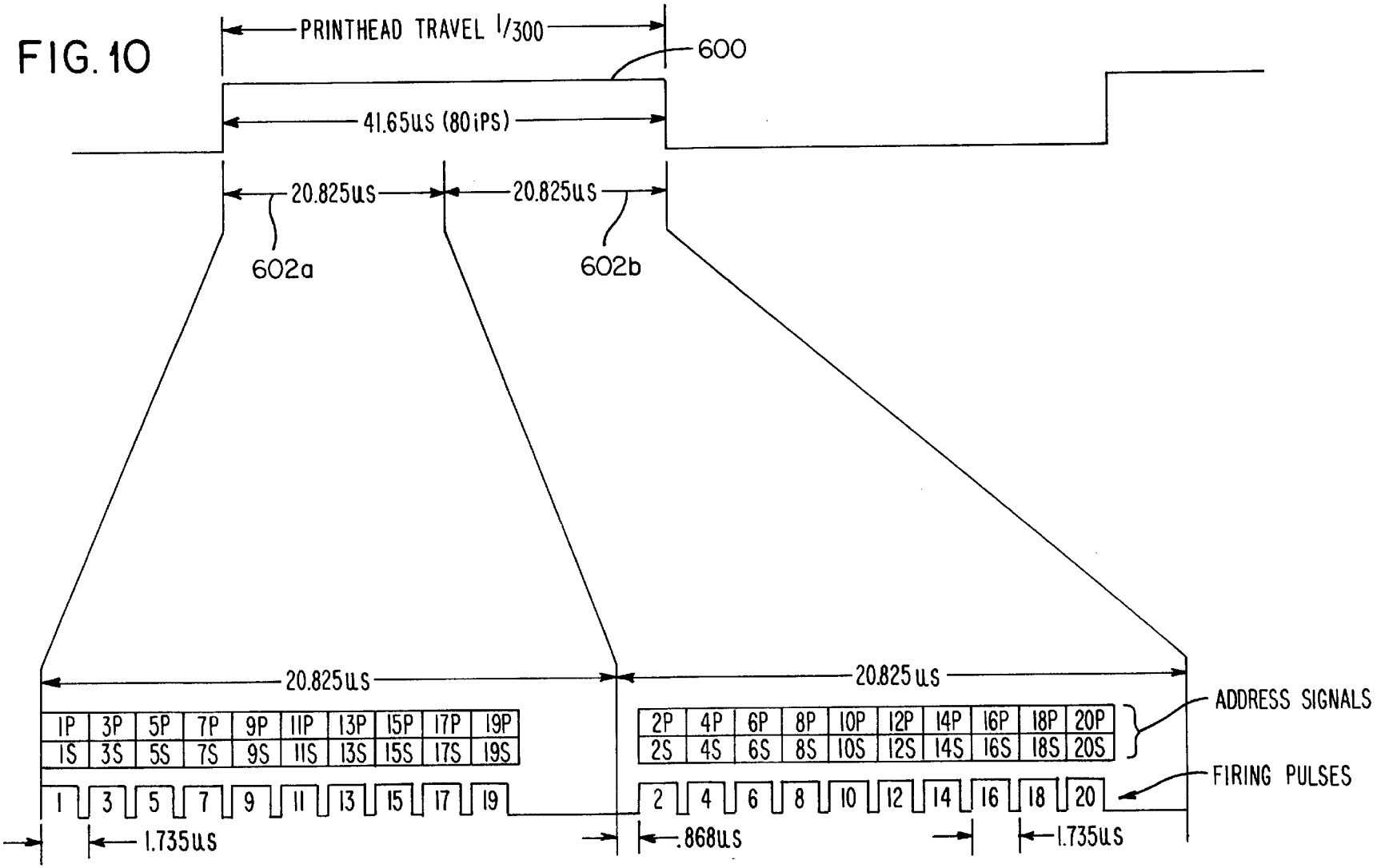
FIG. 10 is a timing diagram for high speed mode operation.

A timing diagram for the high speed mode of operation is illustrated in FIG. 10, wherein an expanded high speed mode firing cycle 600 is shown. The driver circuit 300 is capable of simultaneously applying, depending upon print data received by the microprocessor 310 from the separate processor (not shown) electrically coupled to it, first and third firing pulses to first and third heating elements 52, i.e., the heating elements 52 associated with the first and third nozzles 112 and 122, during a first segment 602*a* of each high speed mode firing cycle, and second and fourth firing pulses to second and fourth heating elements 52, i.e., the heating elements 52 associated with the second and fourth nozzles 114 and 124, during a second segment 602*b* of each high speed mode firing cycle.

During the first segment 602*a* of the high speed mode firing cycle, the ASIC 320 causes the decoder circuitry 340 to cycle through its odd address lines 344 such that the first and third heating elements associated with the first and third nozzles 112 and 122 in segments IA–VIIIA and IB–VIIIB are enabled. During the second segment 602*b* of the high speed mode firing cycle, the ASIC 320 causes the decoder circuitry 340 to cycle through its even address lines 344 such that the second and fourth heating elements associated with the second and fourth nozzles 114 and 124 in segments IA–VIIIA and IB–VIIIB are enabled. The first and second outputs 330*a* and 330*c* are selectively enabled or activated during the first and second segments 602*a* and 602*b*. For example, the two outputs 330*a* and 330*c* may be enabled simultaneously during the first segment 602*a* if both of a given pair of first and third heating elements are to be fired and may be enabled simultaneously during the second segment 602*b* if both of a given pair of second and fourth heating elements are to be fired. If only the first heating element of a given pair of heating elements 52 associated with a pair of first and third nozzles 112 and 122 is to be fired during the first segment 602*a*, only the first output 330*a* will be enabled. If only the third heating element 52 of a given pair of heating elements 52 associated with a pair of first and third nozzles 112 and 122 is to be fired, only the second output 330*c* will be enabled. If only the second heating element of a given pair of heating elements 52 associated with a pair of second and fourth nozzles 114 and 124 is to be fired during the second segment 602*b*, only the first output 330*a* will be enabled. If only the fourth heating element 52 is to be fired, only the second output 330*c* will be enabled.

The length of time of each of the first and second segments 602*a* and 602*b* of the high speed mode firing cycle is from about 15 μseconds to about 25 μseconds. The printhead speed is from about 66.66 inches/second to about 111.12 inches/second. In the illustrated embodiment, the length of time of each of the segments 602*a* and 602*b* is about 20.825 μseconds such that the total firing cycle time is approximately 41.65 μseconds. Further, the printhead speed is about 80 inches/second such that the printhead travels approximately 1/300 inch per firing cycle. Additionally, at the beginning of the second segment 602*b*, there is a delay of about 0.888 μseconds before the heating elements associated with the number 2 and number 4 nozzles are fired.

Figure 11:
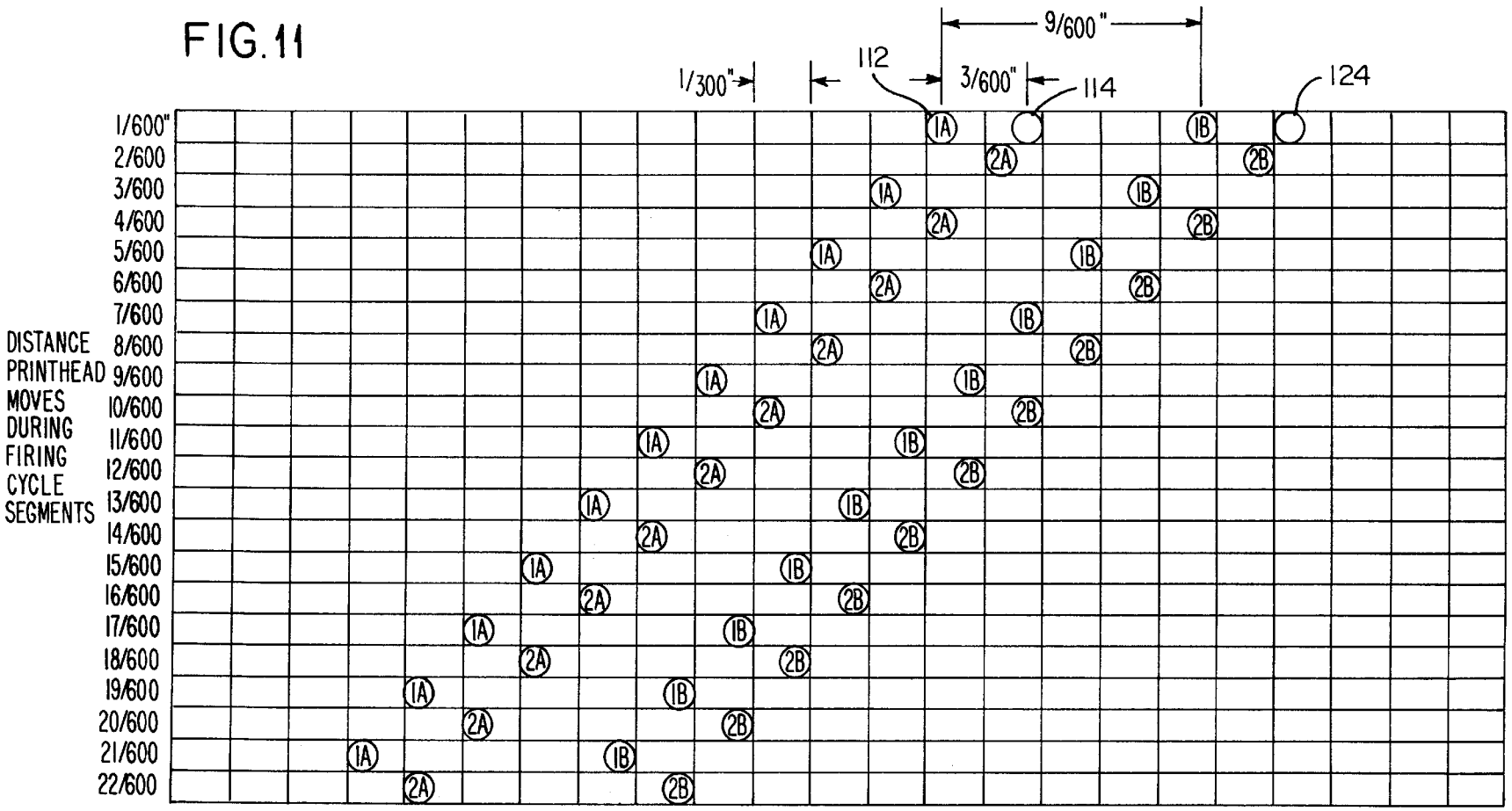
FIG. 11 is a plot showing dots generated by first, second, third and fourth nozzles during consecutive segments of high speed mode firing cycles.

In FIG. 11, a plot is illustrated showing dots generated by a first nozzle 112, a second nozzle 114, a third nozzle 122 and a fourth nozzle 124 during high speed mode operation. The initial positions of the nozzles 112, 114, 122 and 124 are shown. Dots generated by the nozzles 112, 114,122 and 124 are represented by numbered circles, wherein dots 1A are formed by the first nozzle 112, dots 2A are formed by the second nozzle 114, dots 1B are formed by the third nozzle 122 and dots 2B are formed by the fourth nozzle 124. As can be seen from FIG. 11, during a first segment 602*a* of a high speed mode firing cycle, nozzles 112 and 122 are fired and the printhead moves a distance across the paper substrate 12 equal to 1/600 inch. During a second segment 602*b* of the normal speed mode firing cycle, nozzles 114 and 124 are fired and the printhead moves another 1/600 inch across the paper substrate 12. As is apparent from FIG. 11, the dots created by the nozzles 112, 114, 122 and 124 are positioned on a 600 dots per inch horizontal grid.

At an appropriate time during operation of the printing apparatus 10, the primary and secondary nozzles 110 and 120 are tested to determine if they are operational. Nozzle testing takes place at a maintenance station 410 (also referred to herein as a nozzle testing station), see FIGS. 1 and 12, located within the printing apparatus 10. As will be discussed more explicitly below, the station 410 includes a conventional light-emitting diode (LED) light source 600 and a conventional light receiving photocell 602. The microprocessor 310 controls the operation of the light source 600 and the photocell 602. When a heating element 52 associated with one of the nozzles 110 and 120 is fired, ink passing from the fired nozzle causes an interruption or blockage of all or a substantial portion of a beam of light 600*a* emitted from the light source 600. The interruption is detected by the photocell 602 which, in response, generates an ink-sensed signal to the microprocessor 310. In order to ensure that an ink droplet ejected from one of the nozzles 110 and 120 causes a sufficient interruption in the light beam 600*a*, the diameter of the light beam 600*a* is preferably from about 1/600 inch to about 1/150 inch. The remaining structure forming the maintenance station 410 may be constructed as set out in commonly assigned U.S. Pat. Nos. 5,563,637, 5,612,722 and 5,627,572, the disclosures of which are incorporated herein by reference.

Figure 12:
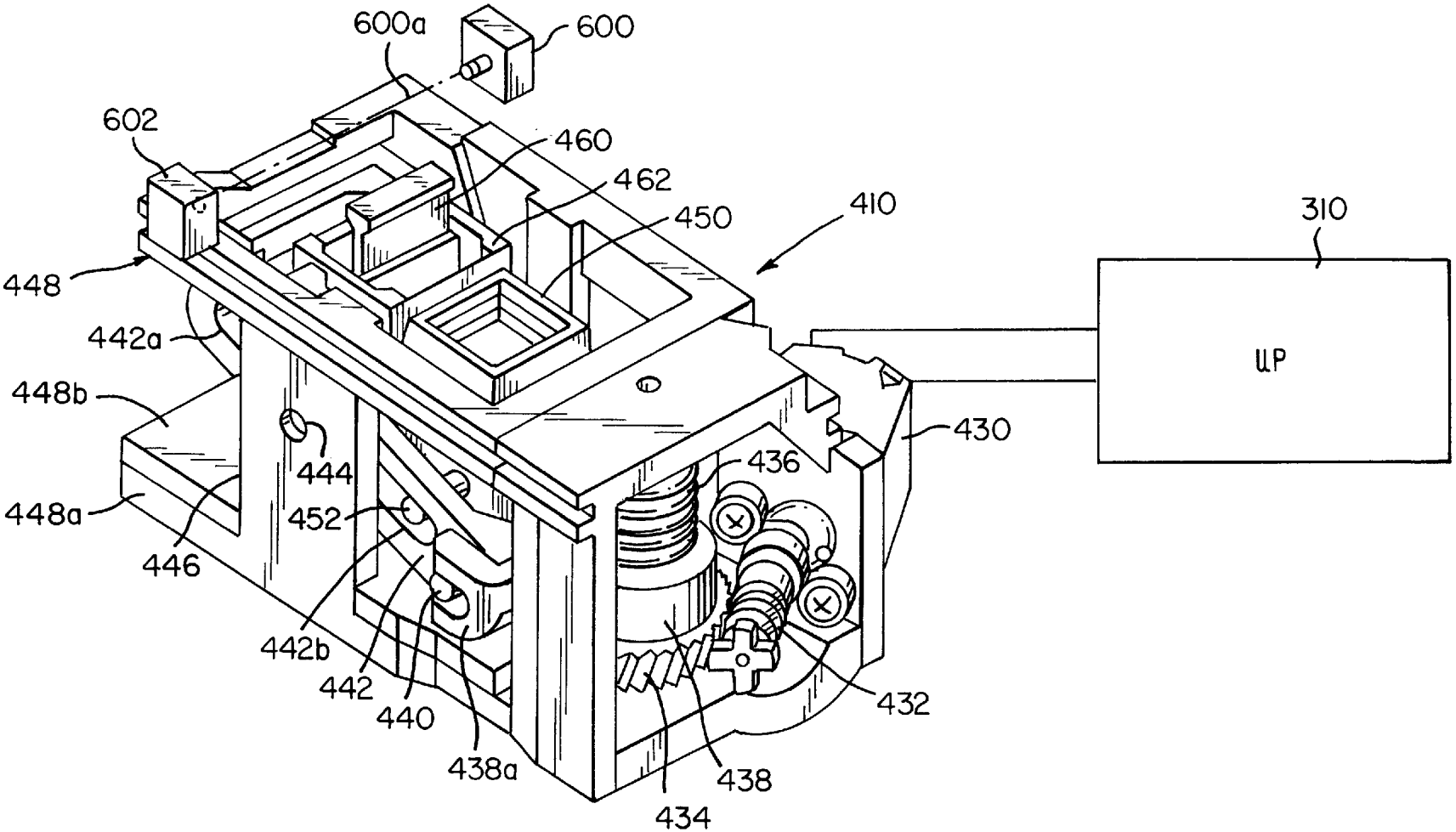
FIG. 12 is a perspective view of a maintenance station of the apparatus of the present invention.

In the illustrated embodiment, the maintenance station 410 includes a bi-directional drive motor 430 driving a worm gear 432 that meshes with a gear 434, see FIG. 12. A drive screw 436 is mounted on the same shaft as the gear 434 and carries a drive nut 438. Depending on the direction of energization of the motor 430, the worm gear 432 is driven in one direction or the other so as to rotate the drive screw 436. Depending upon the direction of movement of the drive screw 436 the drive nut 438 moves upward or downward.

The drive nut 438 has two forked arms 438*a* (only one is shown in FIG. 12), extending outwardly therefrom. The forked arms 438*a* engage two projections 440 (only one is shown in FIG. 12) provided on opposite sides of a rocker frame 442. The frame 442 is pivotally supported by pivots extending into holes 444 in opposing sides 446 of a maintenance station frame 448 so that as the drive nut 438 is moved up or down the rocker frame 442 pivots about the axes of the holes 444.

The rocker frame 442 has two slots 442*a* and 442*b* on one side and two similar slots on an opposite side. A cup-like cap 450 is mounted on a cap support having two projections 452 extending into the slots 442*b*. The cap support is slidably mounted for vertical movement along a post (not shown) extending upwardly from a base 448*a* of the station frame 448.

A wiper 460 is mounted on a spit cup 482 and the spit cup 462 is mounted on a support (not shown) having projections extending into the slots 442*a*. The arrangement is such that as the rocker frame 442 tilts clockwise, as viewed in FIG. 12, the cup 450 is lowered and the wiper 460 is raised, and as the rocker frame 442 tilts counter-clockwise the cup 450 is raised and the wiper 460 is lowered.

The maintenance station 410 and the printhead 24 are disposed on opposite sides of a plane in which the paper substrate 12 is fed past the printhead 24, with the top surface of the maintenance station 410 slightly below and preferably to one side of the paper feed path. The motor 430 moves the rocker frame 442 between three operative positions: a wiper active position where the wiper 460 extends, e.g., 0.5 mm, above the path traversed by the nozzle plate 54 so that the wiper 460 engages the nozzle plate outer surface as the printhead 24 is moved past the wiper 460 by the print cartridge drive mechanism 44; a cap active position where the cap 450 presses against the nozzle plate outer surface when the printhead 24 is positioned over the cap 450 to form a closed environment around the nozzles 110 and 120; and an inactive position where the cap 460 and the wiper 460 are positioned below the paper feed path and are in inactive positions.

In the illustrated embodiment, nozzle testing, which may occur before, during and/or after a print job, is effected in the following manner. The printhead 24 is moved horizontally via the print cartridge drive mechanism 44 so that it passes over the beam of light 600*a* emitted from the light source 600. The beam of light 600*a* extends over a portion of the spit cup 462. During movement of the printhead 24 over the light beam 600*a*, the wiper 460 may be in its active position, as illustrated in FIG. 12, or it may be in its inactive position, i.e., the position where both the cap 450 and the wiper 460 are located in inactive positions. It may be beneficial for the wiper 460 to be in its inactive position as the printhead 24 will make multiple passes over the spit cup 462 during nozzle testing.

The drive mechanism 44 is capable of moving the print cartridge 20 in increments of about 1/600 inch. As noted above, the diameter of the light beam 600*a* is from about 1/600 inch to about 1/150 inch. Because the drive mechanism 44 in the illustrated embodiment cannot move the printhead 24 in increments of less than about 1/600 inch, the light beam has a diameter of about 1/300 inch and it is preferred that the ink droplets pass through the center of the light beam 600*a* so as to maximize the likelihood that detection will occur, the nozzles 110 and 120 are tested while the printhead 24 is moving over the stationary light beam 600*a*.

As the printhead 24 makes one pass over the spit cup 462, the microprocessor 310 effects the firing of the heating elements 52 associated with one-half of the nozzles 110 of one of the primary nozzle segments IA–VIIIA and the heating elements associated with one-half of the nozzles 120 of one of the secondary nozzle segments IB–VIIIB. As noted above, the first, second, third and fourth nozzles 112, 114, 122 and 124 are positioned respectively in first, second, third and fourth nozzle plate columns 212, 214, 222 and 224. Further, center points of the nozzles 112, 114, 122 and 124 are located in subcolumns within the nozzle plate columns 212, 214, 222 and 224. As a subcolumn passes over the light beam 600*a*, i.e., as the subcolumn passes through a vertical plane extending through and including the light beam 600*a*, the heating element 52 associated with one of the nozzles located in that subcolumn is fired. The specific heating element 52 fired is the one associated with the nozzle that is found in a segment half currently being tested.

For example, assuming that the upper-most nozzles in segments IA and IB, i.e., the uppermost nozzles labeled 1–19 in FIGS. 4–6, are to be tested during a given printhead pass and the nozzle plate 54 is moving from right to left as viewed in FIGS. 4 and 6, the heating element 52 associated with the nozzle 112 located in the upper half of segment IA and in subcolumn 1 of the first column 212 is fired first. This is because subcolumn 1 of the first column 212 will be the first subcolumn to be positioned over the light beam 600*a* as the printhead 24 moves over the beam 600*a* and the spit cup 462. The heating element 52 associated with the nozzle 112 located in the upper half of segment IA and in the third subcolumn in column 212 is fired next. The heating elements associated with the remaining upper-most first nozzles 112 in segment IA are sequentially fired as their nozzles 112 move over the light beam 600*a*. Thereafter, the heating elements 52 associated with the upper-most second nozzles 114 in segment IA are sequentially fired as the second nozzles 114 pass over the light beam 600*a*, followed by the firing of the heating elements 52 associated with the upper-most third and fourth nozzles 122 and 124 of segment IB. Sixteen passes of the printhead 24 are required to effect the testing of each of the nozzles 110 and 120 in the illustrated embodiment. The heating element firing sequence during nozzles testing may be varied from that which is described above.

When a heating element 52 is fired during nozzle testing, an ink droplet is ejected from its associated nozzle. The ink droplet passes through the beam of light 660*a* and causes an interruption or blockage of the light beam 660*a*. The photocell 602 senses interruptions in the beam of light 660*a* resulting from ink droplets passing through the beam of light 660*a*. Upon sensing an interruption in the beam of light 660*a*, the photocell 602 generate an ink-detected signal which is received by the microprocessor 310. If an ink droplet is not sensed by the photocell 602 after the heating element of a given nozzle is fired during nozzle testing, the microprocessor 310 designates that nozzle deflective.

When one of a pair of primary and secondary nozzles 110 and 120 positioned along a given horizontal axis, e.g., the number 1 primary and secondary nozzles in FIG. 4, is found to be defective during nozzle testing, the microprocessor 310 causes the heating element 52 associate with the other of the pair of nozzles 110 and 120, assuming the other nozzle is operable, to operate in the place of the heating element of the one defective nozzle during normal mode operation. Thus, the other nozzle and its associated heating element 52 perform double duty during normal mode operation. Hence, data which would have normally been printed by the defective nozzle will now be printed by the other nozzle located on the same horizontal axis as the defective nozzle.

An ink-absorbent pad 448*b* is located over the base 448*a* of the station frame 448 and functions to absorb ejected ink. Another ink-absorbent pad (not shown) is located in the spit cup 462 and serves to absorb ink ejected during nozzle testing.

It is further contemplated that instead of having a single nozzle plate 54 coupled to a single heater chip 50 including both the primary and secondary nozzles 110 and 120, two separate printheads positioned side-by-side, one including the primary nozzles and the other having the secondary nozzles, may be used.

What is claimed is:

1. An ink jet printing apparatus comprising:

a print cartridge including a heater chip and a nozzle plate coupled to said heater chip, said heater chip having a plurality of heating elements, and said nozzle plate having a plurality of nozzles, each of said nozzles having one of said heating elements associated therewith for generating energy to discharge ink therefrom;

a driver circuit, electrically coupled to said heating elements, for applying firing pulses to said heating elements;

a device for detecting ejected ink from a fired nozzle, said device being located in a nozzle testing station;

a print cartridge drive mechanism for effecting movement of said print cartridge so as to move said nozzle plate through said nozzle testing station; and said driver circuit firing said heating elements as said plurality of nozzles pass through said nozzle testing station.

2. An ink jet printing apparatus as set forth in claim 1, wherein said plurality of nozzles comprise primary nozzles and secondary nozzles, at least one of said secondary nozzles sharing a horizontal axis with at least one of said primary nozzles.

3. An ink jet printing apparatus as set forth in claim 2, wherein said device comprises a light source for generating a beam of light extending along a light beam axis and a photocell for sensing interruptions in said beam of light resulting from ink droplets passing through said beam of light, said photocell generating to said driver circuit ink-detected signals upon sensing interruptions in said beam of light.

4. An ink jet printing apparatus as set forth in claim 1, wherein each of said plurality of said secondary nozzles shares a horizontal axis with a corresponding one of said primary nozzles.

5. An ink jet printing apparatus as set forth in claim 4, wherein each of said primary and secondary nozzles are fired by said driver circuit as said plurality of primary and secondary nozzles pass through said nozzle testing station and are adjacent to said beam of light.

6. An ink jet printing apparatus as set forth in claim 5, wherein said at least one of said secondary nozzles and said at least one of said primary nozzles define an aligned pair of nozzles and when one of said pair of nozzles is found to be defective, said driver circuit causes the one of said heating elements associated with the other of said pair of nozzles to operate in the place of said one of said pair of nozzles during a normal mode of operation.

7. An ink jet printing apparatus as set forth in claim 4, wherein said primary nozzles include first and second nozzles positioned in first and second nozzle plate columns, respectively and said secondary nozzles include third and fourth nozzles positioned in third and fourth nozzle plate columns, respectively.

8. An ink jet printing apparatus as set forth in claim 7, wherein said first nozzles are associated with first heating elements, said second nozzles are associated with second heating elements, said third nozzles are associated with third heating elements and said fourth nozzles are associated with fourth heating elements.

9. An ink jet printing apparatus as set forth in claim 8, wherein said driver circuit simultaneously applies firing pulses to pairs of said first and third heating elements during a first segment of a high speed mode firing cycle and simultaneously applies firing pulses to pairs of said second and fourth heating elements during a second segment of said high speed mode firing cycle.

10. An ink jet printing apparatus as set forth in claim 9, wherein the length of time of each of said first and second segments of said high speed mode firing cycle is from about 15 $\mu$seconds to about 26 $\mu$seconds.

11. An ink jet printing apparatus as set forth in claim 8, wherein said driver circuit applies first firing pulses to said first heating elements during a first segment of a normal speed mode firing cycle, second firing pulses to said second heating elements during a second segment of said normal speed mode firing cycle, third firing pulses to said fourth heating elements during a third segment of said normal speed mode firing cycle, and fourth firing pulses to said third heating elements during a fourth segment of said normal speed mode firing cycle.

12. An ink jet printing apparatus as set forth in claim 11, wherein the length of time of each of said first, second, third and fourth segments of said normal speed mode firing cycle is from about 15 $\mu$seconds to about 25 $\mu$seconds.

13. An ink jet printing apparatus comprising:

a print cartridge including a heater chip and a nozzle plate coupled to said heater chip, said heater chip having a plurality of heating elements, and said nozzle plate having a plurality of primary and secondary nozzles, each of said plurality of primary and secondary nozzles having one of said heating elements associated therewith for generating energy to discharge ink therefrom, and at least one of said secondary nozzles sharing a horizontal axis with at least one of said primary nozzles such that said primary and secondary nozzles located along said horizontal axis define an aligned pair of nozzles;

a device, located in a nozzle testing station, for detecting ink ejected from said pair of nozzles;

a print cartridge drive mechanism for effecting movement of said print cartridge so as to move said nozzle plate through said nozzle testing station; and a driver circuit, electrically coupled to said print cartridge, for applying firing pulses to said pair of nozzles as said pair of nozzles pass adjacent to said device, and when ink is not detected by said device after one of said pair of nozzles is fired, said driver circuit causes the one of said heating elements associated with the other of said pair of nozzles to operate in the place of said one of said pair of nozzles during a normal mode of operation.

14. An ink let printing apparatus as set forth in claim 13, wherein said device comprises a light source for generating a beam of light extending along a light beam axis and a photocell for sensing interruptions in said beam of light resulting from ink droplets passing through said beam of light, said photocell generating to said driver circuit ink-detected signals upon sensing interruptions in said beam of light.

15. An ink jet printing apparatus as set forth in claim 14, wherein each of said plurality of said secondary nozzles shares a horizontal axis with a corresponding one of said primary nozzles.

16. An ink jet printing apparatus as set forth in claim 15, wherein said primary nozzles include first and second nozzles positioned in first and second nozzle plate columns, respectively and said secondary nozzles include third and fourth nozzles positioned in third and fourth nozzle plate columns, respectively.

17. An ink jet printing apparatus as set forth in claim 16, wherein said first nozzles are associated with first heating elements, said second nozzles are associated with second heating elements, said third nozzles are associated with third heating elements and said fourth nozzles are associated with fourth heating elements.

18. An ink jet printing apparatus as set forth in claim 17, wherein said driver circuit simultaneously applies fining pulses to pairs of said first and third heating elements during a first segment of a high speed mode firing cycle and simultaneously applies firing pulses to pairs of said second and fourth heating elements during a second segment of said high speed mode firing cycle.

19. An ink jet printing apparatus as set forth in claim 18, wherein the length of time of each of said first and second segments of said high speed mode firing cycle is from about 15 $\mu$seconds to about 25 $\mu$seconds.

20. An ink jet printing apparatus as set forth in claim 19, wherein said driver circuit applies first firing pulses to said first heating elements during a first segment of a normal speed mode firing cycle, second firing pulses to said second heating elements during a second segment of said normal speed mode firing cycle, third firing pulses to said fourth heating elements during a third segment of said normal speed mode firing cycle, and fourth firing pulses to said third heating elements during a fourth segment of said normal speed mode firing cycle.

21. An ink jet printing apparatus as set forth in claim 20, wherein the length of time of each of said first, second, third and fourth segments of said normal speed mode firing cycle is from about 15 $\mu$seconds to about 25 $\mu$seconds.

* * * * *

UNITED STATES PATENT AND TRADEMARK OFFICE

CERTIFICATE OF CORRECTION

PATENT NO. : 6,076,910
DATED : June 20, 2000
INVENTOR(S) : Frank Edward Anderson It is certified that error appears in the above-identified patent and that said Letters Patent is hereby corrected as shown below:

Column 13,
Line 17, "claim 1" should read -- claim 3 --.

Signed and Sealed this

Eighth Day of October, 2002

*Attest:*

*Attesting Officer*

JAMES E. ROGAN
*Director of the United States Patent and Trademark Office*